US007097896B2

(12) United States Patent
Merrill

(10) Patent No.: US 7,097,896 B2
(45) Date of Patent: Aug. 29, 2006

(54) INTERLEAVED TOWEL FOLD CONFIGURATION

(75) Inventor: Thomas Glenn Merrill, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 195 days.

(21) Appl. No.: 10/954,424

(22) Filed: Sep. 30, 2004

(65) Prior Publication Data

US 2006/0068162 A1 Mar. 30, 2006

(51) Int. Cl.
*B32B 3/04* (2006.01)

(52) U.S. Cl. ..... 428/126; 221/48

(58) Field of Classification Search ..... 428/126; 221/47, 48; 206/494
See application file for complete search history.

(56) References Cited

U.S. PATENT DOCUMENTS

| | | | |
|---|---|---|---|
| 1,141,395 | A | 6/1915 | Johnston et al. |
| 1,222,261 | A | 4/1917 | Brown et al. |
| 1,228,400 | A | 6/1917 | Brown et al. |
| 1,256,334 | A | 2/1918 | Lazar |
| 1,347,242 | A | 7/1920 | Bartlett |
| 1,501,662 | A | 7/1924 | Horwitt |
| 1,675,700 | A | 7/1928 | Fairchild |
| 1,681,639 | A | 8/1928 | Hansen |
| 1,683,719 | A | 9/1928 | Harralson |
| 1,698,823 | A | 1/1929 | Rasmussen |
| 1,706,166 | A | 3/1929 | Hung |
| 1,886,312 | A | 11/1932 | Stanton |
| 1,962,762 | A | 6/1934 | Campbell |
| 1,989,381 | A | 1/1935 | Samson |
| 2,009,464 | A | 7/1935 | Winter |
| 2,244,630 | A | 6/1941 | Metternich |
| 2,440,993 | A | 5/1948 | West |
| 2,477,223 | A | 7/1949 | West |
| 3,007,605 | A | 11/1961 | Donovan |
| 3,047,141 | A | 7/1962 | Burns |
| 3,119,516 | A | 1/1964 | Donovan |
| 3,199,861 | A | 8/1965 | Presnell et al. |
| 3,207,361 | A | 9/1965 | Marcalus |
| 3,285,599 | A | 11/1966 | Pherson et al. |
| 3,291,477 | A | 12/1966 | Rehr |
| 3,291,478 | A | 12/1966 | Couzens et al. |
| 3,291,479 | A | 12/1966 | Greiner et al. |
| 3,462,043 | A | 8/1969 | Frick |
| 3,572,681 | A | 3/1971 | Nystrand |

(Continued)

FOREIGN PATENT DOCUMENTS

| | | | |
|---|---|---|---|
| DE | 2353112 | A1 | 4/1975 |

(Continued)

*Primary Examiner*—Alexander S. Thomas
(74) *Attorney, Agent, or Firm*—Richard M. Shane

(57) ABSTRACT

A stack of interleaved towels is provided wherein each towel is configured from a sheet of material having a first fold to generate a first panel, a second fold in the sheet substantially parallel to the first fold and creating a second panel, and a third fold substantially parallel to the first and second folds and creating a lead flap and a trailing flap. The lead flap is defined between the first fold and the third fold such that the first fold presents a leading edge for grasping by a user. The trailing flap is defined between the second fold and the third fold. Prior to interfolding, the first panel is positioned directly adjacent the second panel. Additionally, the trailing flap of each sheet of material is disposed between the lead flap and the trailing flap of an adjacent sheet of material such that the sheets of material are interleaved.

20 Claims, 3 Drawing Sheets

U.S. PATENT DOCUMENTS

| | | | | |
|---|---|---|---|---|
| 3,845,948 | A | 11/1974 | Furbeck et al. | |
| 3,980,289 | A | 9/1976 | Harm | |
| 3,980,290 | A | 9/1976 | Sjoman et al. | |
| 4,254,947 | A | 3/1981 | Trogan | |
| 4,548,595 | A | 10/1985 | Heater et al. | |
| 4,623,074 | A | 11/1986 | Dearwester | |
| 4,681,240 | A | 7/1987 | Wyant | |
| 4,741,944 | A | 5/1988 | Jackson et al. | |
| 4,859,518 | A | 8/1989 | Schutz | |
| 4,865,221 | A | 9/1989 | Jackson et al. | |
| 5,118,554 | A | 6/1992 | Chan et al. | |
| 5,219,092 | A | 6/1993 | Morand | |
| 5,332,118 | A | 7/1994 | Muchenfuhs | |
| 5,565,258 | A | 10/1996 | McConnell et al. | |
| 5,607,754 | A | 3/1997 | Giles et al. | |
| 5,609,269 | A | 3/1997 | Behnke et al. | |
| 5,642,835 | A | 7/1997 | Young et al. | |
| 5,730,695 | A | 3/1998 | Hauschild et al. | |
| 5,891,008 | A | 4/1999 | Bavely et al. | |
| 5,899,447 | A | 5/1999 | Muchenfuhs | |
| 6,090,467 | A | 7/2000 | Yip | |
| 6,165,116 | A | 12/2000 | White | |
| 6,213,345 | B1 | 4/2001 | Plank | |
| 6,213,346 | B1 | 4/2001 | Skerrett et al. | |
| 6,238,328 | B1 | 5/2001 | Loppnow et al. | |
| 6,296,143 | B1 | 10/2001 | Ghabriel | |
| 6,306,480 | B1 | 10/2001 | Yardley et al. | |
| 6,378,726 | B1 | 4/2002 | Chan et al. | |
| 6,623,833 | B1 | 9/2003 | Chan | |
| 6,641,894 | B1 * | 11/2003 | Bando | 428/126 |
| 6,644,501 | B1 | 11/2003 | Iida | |
| 6,672,475 | B1 | 1/2004 | Ho et al. | |
| 6,685,050 | B1 | 2/2004 | Schmidt et al. | |
| 6,730,012 | B1 | 5/2004 | Bando | |
| 2002/0051863 | A1 | 5/2002 | Chan | |
| 2002/0060222 | A1 * | 5/2002 | Bando | 221/48 |
| 2003/0116581 | A1 | 6/2003 | Schmidt et al. | |

FOREIGN PATENT DOCUMENTS

| | | | |
|---|---|---|---|
| EP | 0747313 | A1 | 12/1996 |
| EP | 1136412 | A1 | 9/2001 |
| WO | WO 96/26664 | | 9/1996 |

* cited by examiner

INTERLEAVED TOWEL FOLD CONFIGURATION

BACKGROUND

Various fold configurations are well known for use in the sanitary sheet products (i.e., paper towels, tissues, napkins, etc.) art. In general, different fold configurations have been utilized to reduce dimensions of the dispensed products and/or to facilitate the dispensing process. Known fold configurations include basic C-fold, V-fold, Z-fold, M-fold, and numerous other single-ply or multi-ply configurations that may generally be referred to as "folded towels."

Typically, folded sheet towel products of the type dispensed in lavatories are stacked and banded together as a package for shipment and storage. For use, the stacked sheets are loaded into an appropriate dispenser. Adjacent sheets in the stack may be interleafed to promote the appearance of the next sheet in the opening of the dispenser after removal of a sheet. Often, due to the nature of the particular fold configuration, the stack of towels must be loaded with a specific orientation for proper grasping and dispensing by a subsequent user.

A primary and ongoing concern in the industry is to provide the user with a fold configuration that promotes efficient and non-wasteful dispensing of the towels.

One problem encountered with dispensing paper towels of conventional fold configurations is that the towels are typically folded and dispensed in a two-ply configuration that may provide more fiber per sheet than is necessary for efficient drying or that is not particularly amenable to being unfolded by the user into a larger single-ply sheet. The users may not unfold the towel and thus may perceive that the folded towel is not large enough to adequately dry their hands. After using one towel, the user will typically pull another towel to finish the drying process. This results in significant waste.

Thus, there exists a need in the art for an improved fold configuration for stacked towel products that provides efficient and non-wasteful dispensing of optimally sized towels that are readily unfolded and utilized by a user.

SUMMARY OF THE INVENTION

In accordance with the invention, a stack of interleaved towels is provided. Each towel is formed of a single sheet of material having a length and a width, typically a single-ply material. The towels according to the invention are not limited to any particular type of sheet material and may be formed of any absorbent material for use as a towel, wiper, napkin, or other stacked absorbent product. The sheet material may be, for example, a nonwoven, natural, or synthetic fiber material. Desirably, the sheet material is substantially rectangular in shape.

In one embodiment, each sheet of material includes a first fold in the sheet substantially parallel to the width of the sheet to create a first panel folded toward a first surface of the sheet. The first panel extends between the first fold and a first end of the sheet and has a length less than about 25 percent of the overall sheet length. Each sheet of material further includes a second fold in the sheet substantially parallel to the first fold. The second fold creates a second panel folded toward a first surface of the sheet. The second panel extends between the second fold and a second end of the sheet and has a length less than about 25 percent of the overall sheet length. Each sheet of material further includes a third fold in the sheet substantially parallel to the first and second folds. The third fold creates a lead flap and a trailing flap. The lead flap is defined between the first fold and the third fold such that the first fold presents a continuous folded leading edge for grasping by a user. The trailing flap is defined between the second fold and the third fold such that the second fold presents a continuous folded trailing edge. The third fold is configured such that, prior to interfolding, the first panel is positioned directly adjacent the second panel. Additionally, the trailing flap of each sheet of material is disposed between the lead flap and the trailing flap of an adjacent towel such that the sheets of material are interleaved. The lead flap may be shorter than the trailing flap and/or may include a two-ply tab.

In another embodiment, each sheet of material includes a first fold in the sheet substantially parallel to the width of the sheet to create a first panel folded toward a first surface of the sheet. The first panel extends between the first fold and a first end of the sheet and has a length less than about 25 percent of the overall sheet length. Each sheet of material further includes a second fold in the sheet substantially parallel to the first fold. The second fold creates a second panel folded toward the first surface of the sheet. The second panel extends between the second fold and a second end of the sheet and has a length less than about 25 percent of the overall sheet length. Each sheet of material further includes a third fold in the sheet substantially parallel to the first and second folds. The third fold creates a third panel extending between the first and third folds and a fourth panel extending between the second and third folds. The third and fourth panels are desirably folded toward the first surface of the sheet. The third fold is configured such that, prior to interfolding, the first and second ends of the sheet are positioned between the third and fourth panels. Additionally, the second panel of each towel is disposed adjacent the first panel of an adjacent towel such that the towels are interleaved. The third panel may be shorter than the fourth panel. In a further aspect, the second and fourth panels of each towel may be disposed between the first and third panels of the next two upper adjacent towels.

In a further embodiment, each sheet of material includes a first fold in the sheet substantially parallel to the width of the sheet to create a first panel folded toward a first surface of the sheet. The first panel extends between the first fold and a first end of the sheet and has a length less than about 25 percent of the overall sheet length. Each sheet of material further includes a second fold in the sheet substantially parallel to the first fold. The second fold creates a second panel folded toward a first surface of the sheet. The second panel extends between the second fold and a second end of the sheet and has a length less than about 25 percent of the overall sheet length. Each sheet of material further includes a third fold in the sheet substantially parallel to the first and second folds. The third fold creates a lead flap and a trailing flap. The lead flap is defined between the first fold and the third fold. The trailing flap is defined between the second fold and the third fold. The third fold is configured such that, prior to interfolding, the first panel is positioned directly adjacent the second panel. Additionally, the trailing flap of each sheet of material is disposed directly adjacent and between the lead flaps of the next two adjacent towels such that the sheets of material are interleaved. In one aspect, the next two adjacent towels may be the next two upper adjacent towels.

DETAILED DESCRIPTION

Figure 1:
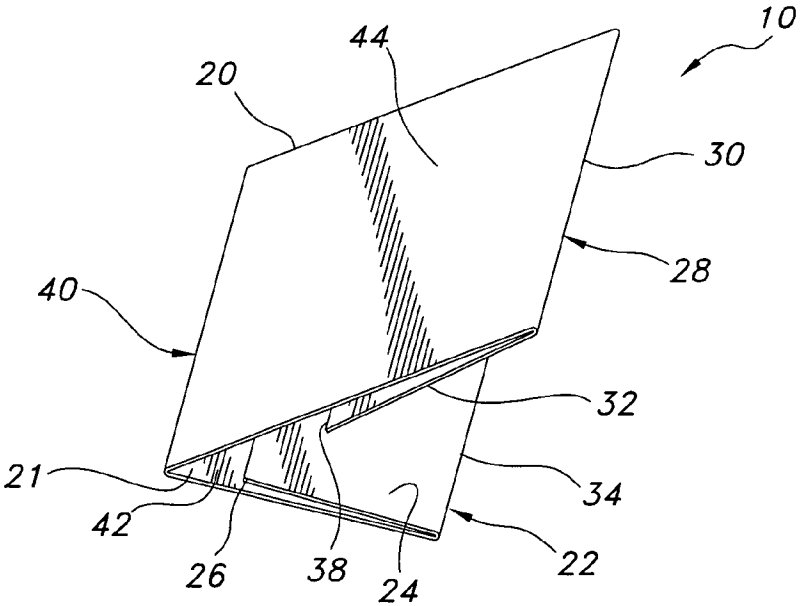
FIG. 1 is a perspective view of a single towel folded into a towel configuration of the present invention.

Reference will now be made in detail to embodiments of the invention, one or more examples of which are shown in the drawings. Each embodiment is presented by way of explaining the invention, and is not meant as a limitation of the invention. For example, features illustrated or described as part of one embodiment may be used with another embodiment to create still further embodiments. It is intended that the present invention include such modifications and variations.

Referring to FIG. 1, there is shown a single towel 10 folded into the towel fold configuration of the present invention. The single sheet employed for the towel 10 is desirably single-ply but may be multi-ply. In addition, the invention is not limited to any particular type of material, and includes any known material for forming absorbent products such as towels, wipes, napkins, and the like. The single sheets are desirably substantially rectangular in shape.

In the embodiment shown, a single sheet 20 having a first surface 21 is folded along a first fold line 22 across the width of the single sheet to create a folded lead edge 34. The first fold line 22 creates a first panel 24 extending between the lead edge 34 and a first end 26 of the sheet. The first panel 24 is desirably folded toward the first surface 21 of the single sheet 20. Desirably, the length of the first panel 24 is less than about 25 percent of the overall length of the single sheet 20. Unless specified otherwise, the lengths herein are measured with respect to the direction perpendicular to the first fold line 22.

A second fold line 28 is imparted across the width of the single sheet 20 to create a folded trailing edge 30. The second fold line 22 creates a second panel 32 extending between the folded trailing edge 30 and a second end 38 of the sheet 20. The second panel 32 is desirably folded toward the first surface 21 of the single sheet 20. Desirably, the length of the second panel 32 is less than about 25 percent of the overall length of the single sheet 20.

A third fold line 40 is imparted to the single sheet 20 substantially parallel to and between the first and second fold lines 22, 28. The third fold line 40, which is desirably a one-ply fold of the single-ply sheet material 20, thereby creates a third panel 42 extending between the first and third fold lines 22, 40, and a fourth panel 44 extending between the second and third fold lines 28, 40. The direction of the third fold 40 is such that the first and second ends 26, 38 of the sheet 20 are positioned between the third and fourth panels 42, 44. Put another way, the first, second, and third folds 22, 28, 40 are all three positioned on the same side of the sheet 20. In other words, the third fold 40 is made such that, prior to interfolding, the first panel 24 is positioned directly adjacent the second panel 32. The length of the third panel 42 may range from about 25 percent to about 100 percent of the length of the fourth panel 44. The length of the third panel 42 ranges desirably from about 50 percent to about 95 percent of the length of the fourth panel 44, and more desirably from about 75 percent to about 90 percent of the length of the fourth panel to facilitate dispensing and/or unfolding of the towels 10. For example, in one embodiment the length of the third panel 42 is about 80 percent of the length of the fourth panel 44. The length of the first panel 24 is desirably from about 5 percent to about 100 percent of the length of the third panel 42, more desirably from about 25 percent to about 95 percent of the length of the third panel, and even more desirably from about 50 percent to about 90 percent of the length of the third panel. For example, in one embodiment the length of the first panel 24 is about 70 percent of the length of the third panel 42. The length of the second panel 32 is desirably from about 5 percent to about 100 percent of the length of the fourth panel 44, more desirably from about 25 percent to about 95 percent of the length of the fourth panel, and even more desirably from about 40 percent to about 80 percent of the length of the fourth panel. For example, in one embodiment the length of the second panel 32 is about 60 percent of the length of the fourth panel 44.

Figure 2:
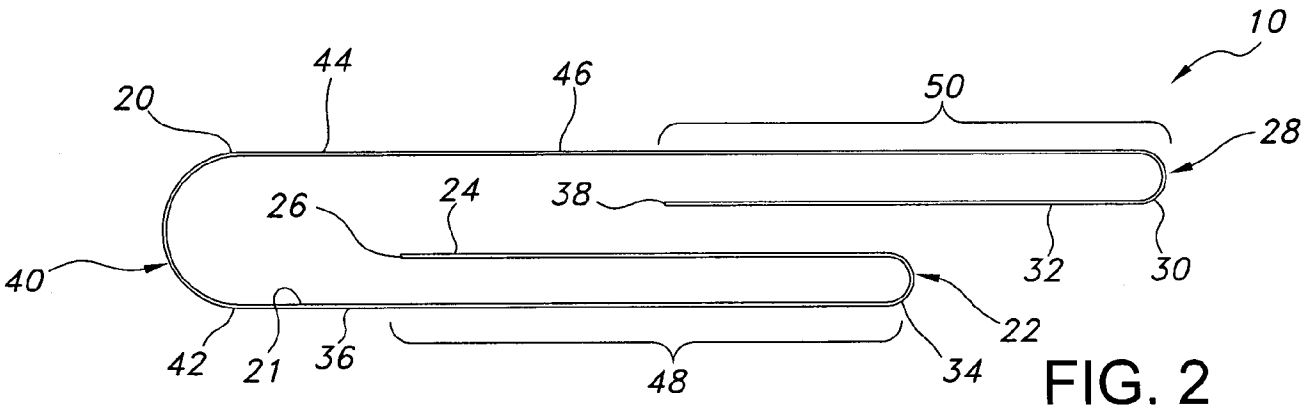
FIG. 2 is an end schematic view of a towel folded in accordance with the configuration of FIG. 1.

The third fold line 40 also creates a lead flap 36 and a trailing flap 46. The lead flap 36 is defined between the third fold line 40 and the first fold line 22. The lead flap 36 is two-ply as a result of the first fold line 22 that created the folded lead edge 34 and the first panel 24. The lead flap 36 has a leading two-ply tab 48 running the width of the towel 10 having the lead edge 34 that is folded as shown most clearly in FIG. 2. Desirably, the leading two-ply tab 48 extends substantially the entire length of the lead flap 36. The lead edge 34 is the leading portion of the lead flap 36 that extends through a dispensing slot or opening 18 of a dispenser 16 for grasping by a user, as particularly seen in FIG. 4. It is desirable that the user be presented with a two-ply lead flap 36 to reduce tearing of the towel 10 upon dispensing thereof. The force exerted by the user in pulling the towel 10 is transmitted through both plies of the lead flap 36, thereby minimizing tabbing failures. Tabbing failures occur where a user with wet hands grasps the towel to be dispensed, for example, between thumb and forefinger. As the user pulls on a small section of towel, which is now wet, it may fail such that the user is left with a small "tab" of towel between his thumb and forefinger with the remainder of the towel remaining in the dispenser.

The trailing flap 46 is defined between the second fold line 28 and the third fold line 40. The trailing flap 46 has a trailing two-ply tab 50 running the width of the towel 10 having the trailing edge 30 that is folded as shown most clearly in FIG. 2. The trailing flap 46 is at least partially two-ply as a result of the second fold line 28 that created the folded trailing edge 30. Desirably, the trailing two-ply tab 50 extends substantially the entire length of the trailing flap 46. The lead flap 36 and the trailing flap 46 have lengths that correspond to the lengths of the third and fourth panels 42, 44, respectively, as are described above. Because the trailing flap 46 has the trailing two-ply tab 50, an interleaved stack of towels 10 may be inserted upside-down in a dispenser 16 without losing the functionality of the two-ply lead flap 36. In such a case, the trailing flap 46 becomes the lead flap 36 and the lead flap becomes the trailing flap.

The overall length of the single sheet 20 is desirably less than about 160 percent of the overall width of the single sheet, more desirably less than about 140 percent of the overall width of the single sheet, and even more desirably less than about 120 percent of the overall width of the single sheet. In one embodiment, the overall length of the single sheet 20 is substantially equal to the overall width of the single sheet. That is, in one embodiment the sum of the lengths of the first, second, third, and fourth panels 24, 26, 42, 44 is substantially equal to the width of the single sheet 20, the width corresponding to the length of the first fold line 22. As one example, the single sheet 20 may be from about 9 to about 11 inches long and from about 9 to about 11 inches wide. As another example, the single sheet 20 may be about 10.4 inches long and about 9.4 inches wide. After folding, the length of the folded towel 10 would desirably be reduced to from about 3.1 to about 3.7 inches, more desirably to about 3.4 inches, while the width would remain at about 9.25 inches wide. In another embodiment, the length of the towel 10 is about 10.2 inches, the length of the first panel 24 is about 2.0 inches, the length of the second panel 26 is about 2.0 inches, the length of the third panel 42 is about 2.8 inches, and the length of the fourth panel 44 is about 3.4 inches.

Figure 3:
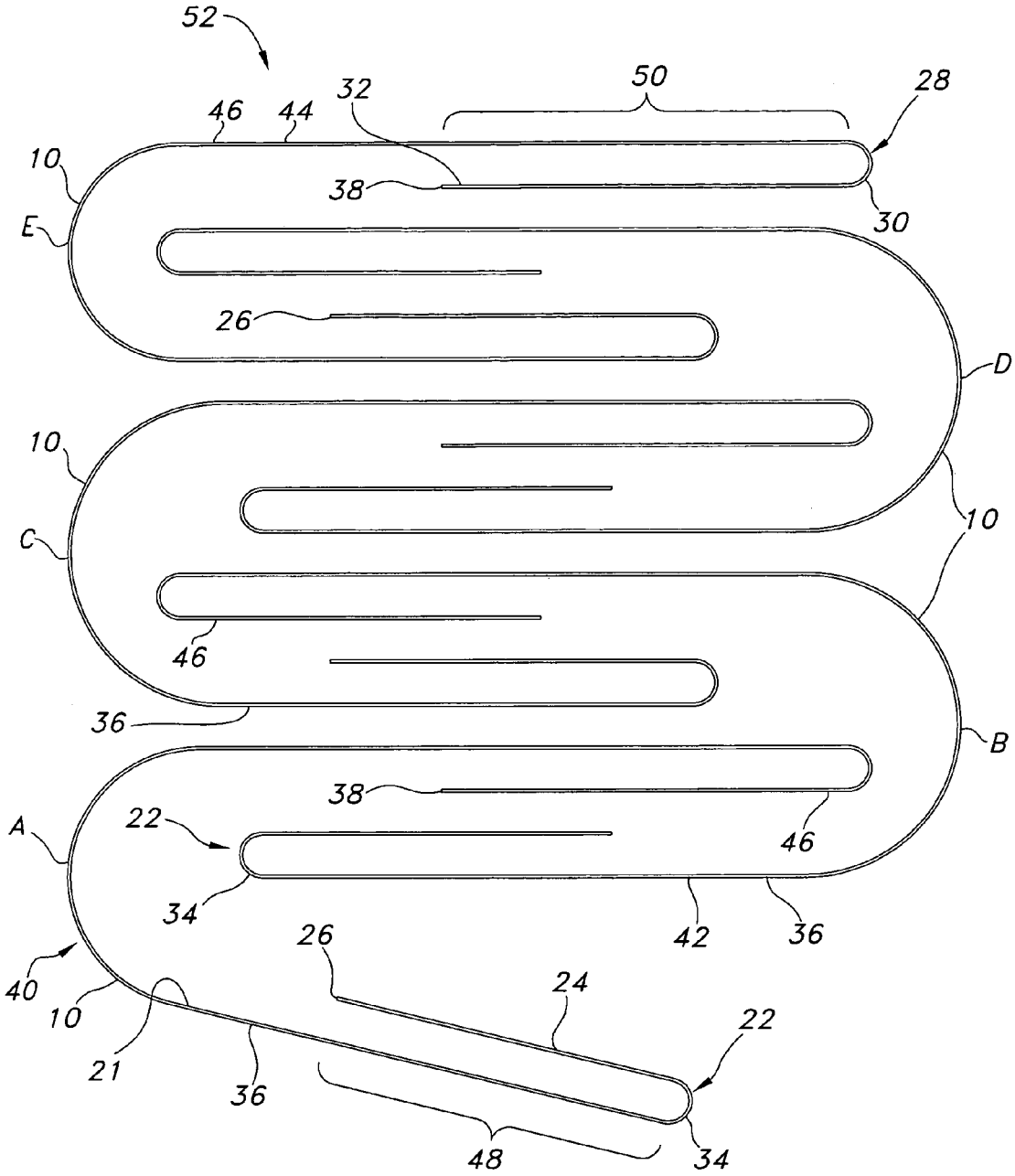
FIG. 3 is an end schematic view of an interleaved stack of towels of the present invention.
Figure 4:
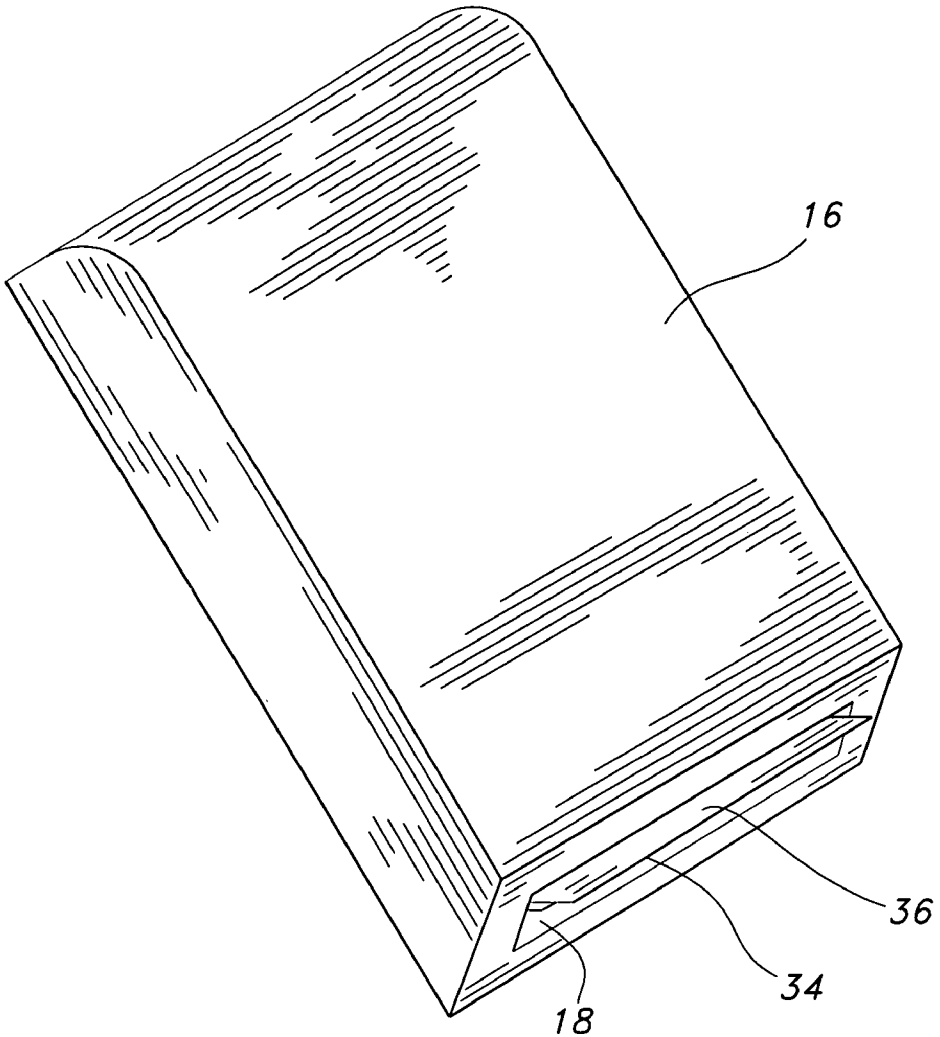
FIG. 4 is a perspective view of a conventional towel dispenser with the lead flap of a single towel extending through the dispensing opening.

Looking next at FIG. 3, there is shown a schematic end view of a stack 52 of five towels 10 of the fold configuration of the present invention. In practice, the stack 52 would desirably include from about 75 to about 350 towels 10. For purposes of clarity, the five towels 10 depicted in FIG. 3 are labeled A, B, C, D and E. The towels 10 are arranged in the stack 52 such that the lead flap 36 of towel A will extend through the dispensing opening or slot 18 in the dispenser 16, as illustrated in FIG. 4. The trailing flap 46 of each towel 10 is disposed between the lead flap 36 and the trailing flap 46 of an adjacent towel such that the towels are interleaved. While the trailing flap 46 of each towel 10 is disposed between the lead flap 36 and the trailing flap 46 of the next adjacent towel after interleaving, the trailing flap 46 of each towel 10 is also disposed directly adjacent and between the lead flaps 36 of the next two adjacent towels.

Walking through the dispensing of a few of the towels 10 of stack 48 will illustrate a number of advantages of the present invention. Assuming that the lead edge 34 of towel A is extending through the dispensing opening 18 of a dispenser 16, the user grasps towel A typically somewhere along leading two-ply tab 48. As the user pulls towel A through the dispensing opening 18, the trailing flap 46 of towel A drags the lead flap 36 of towel B through the dispensing opening, ready for dispensing next. The frictional forces between the trailing flap 46 of towel A and the lead flap 36 of towel B reduce the chance that the trailing flap of towel A could be withdrawn while leaving the lead flap of towel B inside the dispenser. Further, the two-ply leading edge 34 of the towel 10 next to be dispensed extends through the dispensing opening 18 of the dispenser 16. As such, the user can grasp the lead flap 36, thus spreading the force required to withdraw the towel 10 over the leading two-ply tab 48 of the towel 10. It is believed that this distribution of forces minimizes the incidence rate of tear-out and tab-out failure of the dispensing of towel A. The user may now grab the leading two-ply tab 48 of towel B causing it to be dispensed. As towel B is dispensed, the lead flap 36 of towel C is pulled through the dispensing opening 18 of the dispenser 16.

As towel A of FIG. 3 is being dispensed, the lead flap 36 of towel C provides support to towel B to prevent multiple dispensing wherein towel B would be dragged through the dispensing opening 18 simultaneously with towel A, thus creating potential waste. The support provided by the lead flap 36 of towel C in retaining towel B is given added rigidity due to the fact that lead flap 36 is at least partially double-ply. Thus it can be seen that the towel fold configuration of the present invention provides an at least partially double-ply lead flap 36 to reduce tab-out and tear-out of the towel 10 upon dispensing and also provide sufficient support to the towel 10 next to be dispensed to prevent multiple dispensing. Additionally, the towel fold configuration of the present invention provides an at least partially two-ply trailing flap 46 so that dispensing performance will not be reduced if the stack of towels 52 is inserted upside-down in the dispenser 16, as described above.

The two-ply lead flap 36 of the towel 10 next to be dispensed provides an advantage even over a typical laminated two-ply V-fold towel. It is known that laminated two-ply towels can delaminate. Delamination can occur at the dispensing opening as a result of the forces imparted on the lead end of such an interleaved, laminated two-ply towel when it is dragged through the dispensing opening of a dispenser by the trailing flap of the towel immediately preceding it. Delamination in such manner may present to the user two (2) lead flaps. If the user grasps a single ply of the two-ply sheet, it is likely to result in a tear-out or tab-out failure of dispensing, particularly if the user's hands are wet. Because the two-ply nature of the towel 10 of the present invention is created by folding a single sheet 20, and because the leading two-ply tab 48 is always at the folded lead edge 34, the user will always be grasping a two-ply tab. The force exerted by the user in dispensing a towel 10 is always transmitted through both plies thereby adding strength and minimizing tab-out failure.

It is known that superior water absorbency is achieved when paper towels are used in a two-ply configuration. The towel 10 of the present invention allows such usage even though it may be formed from a single-ply sheet 20. As the towel 10 is dispensed, the action of the trailing flap 46 in pulling the lead flap 36 of the towel next to be dispensed causes the towel 10 being dispensed to open at the third fold line 40. After dispensing and prior to further unfolding, the towel 10 as dispensed is at least partially two-ply. Desirably, the towel as dispensed is at least 25 percent two-ply, more desirably at least 50 percent two-ply, and even more desirably at least 66 percent two-ply. The user is thus presented with an option to use the towel 10 as presented or to unfold the first and/or second fold to obtain a larger towel size. Depending on the user's needs, either option may be desirable.

The towel 10 of the present invention is desirably designed for use in a typical C-fold, V-fold, or M-fold dispenser such as depicted in FIG. 4. An exemplary dispenser is Scott Towel Dispenser No. 0995 that has inside dimensions of 3.8" by 10.6". The towel 10 desirably employs a sheet material that has a water capacity greater than about 2 grams of water per gram of sheet material, a machine direction absorbency rate of greater than about 1 centimeter per 15 seconds, a basis weight ranging from about 10 to about 150 grams per square meter, and a geometric mean tensile strength ranging from about 200 to about 2500 grams-force per 25.4 millimeters wide strip. More desirably, the basis weight ranges from about 20 to about 45 grams per square meter, and the geometric mean tensile strength ranges from about 800 to about 1700 grams-force per 25.4 millimeters wide strip. Generally, a towel having a basis weight of 30 grams per square meter and a geometric mean tensile strength of about 1150 grams-force per 25.4 millimeters wide strip is even more desirable.

As used herein, water capacity is a measure of the quantity of water absorbed per grams of fiber in the towel as used. Machine direction absorbency rate is a measure of the distance water travels (cm) in the machine direction of the sheet in fifteen seconds. Basis weight is expressed in grams per square meter. Geometric mean tensile strength is a composite property equal to the square root of the tensile strength of the web in the machine direction multiplied by the tensile strength of the web in the cross machine direction in grams-force per 25.4 millimeter sample width.

As used herein and in the claims, the terms "comprising" and "including" are inclusive or open-ended and do not exclude additional unrecited elements, compositional components, or method steps. Accordingly, the terms "comprising" and "including" encompass the more restrictive terms "consisting essentially of" and "consisting of."

It should be appreciated by those skilled in the art that various modifications and variations can be made in the fold configuration according to the invention without departing from the scope and spirit of the invention. It is intended that the invention include such modifications and variations as come within the scope of the appended claims and their equivalents.

The invention claimed is:

1. A stack of interleaved towels, each of the towels comprising: a sheet of material having a length and a width; a first fold in the sheet substantially parallel to the width of the sheet and creating a first panel folded toward a first surface of the sheet and extending between the first fold and a first end of the sheet, the length of the first panel being less than about 25 percent of the overall length of the sheet; a second fold in the sheet substantially parallel to the first fold and creating a second panel folded toward the first surface of the sheet and extending between the second fold and a second end of the sheet, the length of the second panel being less than about 25 percent of the overall length of the sheet; and, a third fold in the sheet substantially parallel to and between the first and second folds and creating a lead flap extending between the first and third folds and a trailing flap extending between the second and third folds; wherein the first panel is adjacent the second panel prior to interleaving; and, wherein the trailing flap of each towel is disposed between the lead flap and the trailing flap of an adjacent towel such that the towels are interleaved.

2. The stack of interleaved towels as in claim 1, wherein the sheet of material is a single-ply material.

3. The stack of interleaved towels as in claim 1, wherein the lead flap is shorter than the trailing flap.

4. The stack of interleaved towels as in claim 1, wherein the lead flap comprises a two-ply tab.

5. The stack of interleaved towels as in claim 1, wherein the length of the first panel is from about 50 percent to about 90 percent of the length of the lead flap.

6. The stack of interleaved towels as in claim 1, wherein the sheet material is substantially rectangular in shape.

7. The stack of interleaved towels as in claim 1, wherein the overall length of the sheet material is less than about 160 percent of the overall width of the sheet material.

8. The stack of interleaved towels as in claim 1, wherein the overall length of the sheet material is substantially equal to the overall width of the sheet material.

9. The stack of interleaved towels as in claim 1, wherein the length of the lead flap is from about 25 percent to about 100 percent of the length of the trailing flap.

10. A stack of interleaved towels, each of the towels comprising: a sheet of material having a length and a width; a first fold in the sheet substantially parallel to the width of the sheet and creating a first panel folded toward a first surface of the sheet and extending between the first fold and a first end of the sheet, the length of the first panel being less than about 25 percent of the overall length of the sheet; a second fold in the sheet substantially parallel to the first fold and creating a second panel folded toward the first surface of the sheet and extending between the second fold and a second end of the sheet, the length of the second panel being less than about 25 percent of the overall length of the sheet; and, a third fold in the sheet substantially parallel to the first fold and creating a third panel extending between the first and third folds and a fourth panel extending between the second and third folds; wherein the first and second ends of the sheet are positioned between the third and fourth panels; and, wherein the second panel of each towel is disposed adjacent the first panel of an adjacent towel such that the towels are interleaved.

11. The stack of interleaved towels as in claim 10, wherein the second and fourth panels of each towel are disposed between the first and third panels of the next two upper adjacent towels.

12. The stack of interleaved towels as in claim 10, wherein the third panel is shorter than the fourth panel.

13. The stack of interleaved towels as in claim 10, wherein the length of the first panel is from about 50 percent to about 90 percent of the length of the third panel.

14. The stack of interleaved towels as in claim 10, wherein the sheet of material is a single-ply material.

15. The stack of interleaved towels as in claim 10, wherein the sheet material is substantially rectangular in shape.

16. The stack of interleaved towels as in claim 10, wherein the overall length of the sheet material is less than about 160 percent of the overall width of the sheet material.

17. The stack of interleaved towels as in claim 10, wherein the overall length of the sheet material is substantially equal to the overall width of the sheet material.

18. The stack of interleaved towels as in claim 10, wherein the length of the third panel is from about 25 percent to about 100 percent of the length of the fourth panel.

19. A stack of interleaved towels, each of the towels comprising: a sheet of material having a length and a width; a first fold in the sheet substantially parallel to the width of the sheet and creating a first panel folded toward a first surface of the sheet and extending between the first fold and a first end of the sheet, the length of the first panel being less than about 25 percent of the overall length of the sheet; a second fold in the sheet substantially parallel to the first fold and creating a second panel folded toward the first surface of the sheet and extending between the second fold and a second end of the sheet, the length of the second panel being less than about 25 percent of the overall length of the sheet; and, a third fold in the sheet substantially parallel to and between the first and second folds and creating a lead flap extending between the first and third folds and a trailing flap extending between the second and third folds; wherein the first panel is adjacent the second panel prior to interleaving; and, wherein the trailing flap of each towel is disposed directly adjacent and between the lead flaps of the next two adjacent towels such that the towels are interleaved.

20. The stack of interleaved towels as in claim 19, wherein the trailing flap of each towel is disposed directly adjacent and between the lead flaps of the next two upper adjacent towels.

* * * * *